US006874172B2

(12) United States Patent
Frost

(10) Patent No.: US 6,874,172 B2
(45) Date of Patent: Apr. 5, 2005

(54) DUAL DISCHARGE VALVE

(75) Inventor: Douglas Robert David Frost, 14 Boulton Close, Burntwood, Staffordshire (GB), WS7 9LD

(73) Assignees: Douglas Robert David Frost, Burntwood (GB); John Blackborow, Usk (GB)

( * ) Notice: Subject to any disclaimer, the term of this patent is extended or adjusted under 35 U.S.C. 154(b) by 0 days.

(21) Appl. No.: 10/311,958

(22) PCT Filed: Jun. 22, 2001

(86) PCT No.: PCT/GB01/02767

§ 371 (c)(1),
(2), (4) Date: Dec. 20, 2002

(87) PCT Pub. No.: WO02/01010

PCT Pub. Date: Jan. 3, 2002

(65) Prior Publication Data

US 2004/0073993 A1 Apr. 22, 2004

(30) Foreign Application Priority Data

Jun. 27, 2000 (GB) ..... 0015583

(51) Int. Cl.[7] ..... E03D 1/34; E03D 1/14
(52) U.S. Cl. ..... 4/378; 4/324; 4/325
(58) Field of Search ..... 4/378, 324, 325, 4/326, 327, 384, 385, 412, 413, 414, 415, 353

(56) References Cited

U.S. PATENT DOCUMENTS 4,566,140 A * 1/1986 Musgrove ..... 4/324
4,882,793 A * 11/1989 Thompson ..... 4/324
5,713,086 A * 2/1998 Diethelm ..... 4/325
5,926,861 A * 7/1999 Frost ..... 4/324

FOREIGN PATENT DOCUMENTS

| | | | |
|---|---|---|---|
| DE | 3618671 A1 | * | 1/1987 |
| EP | 0448092 A1 | * | 3/1991 |
| EP | 0955417 A2 | | 11/1999 |
| FR | 2594866 A1 | * | 2/1986 |
| GB | 2336605 A | | 10/1999 |

* cited by examiner

*Primary Examiner*—Gregory L. Huson
*Assistant Examiner*—Khoa Huynh
(74) *Attorney, Agent, or Firm*—Pillsbury Winthrop LLP

(57) ABSTRACT

A dual discharge valve for immersion in fluid, in a cistern includes a housing having an upper portion and a lower portion. An upwardly movable main valve assembly within the housing forms therewith a variable volume upper chamber and lower chamber. A first vent means is between the upper and lower chambers and an outlet leads down from the lower housing portion, which portion contains a seat for the main valve assembly at the entry to the outlet so that in the lowered position of the main valve assembly the outlet is blocked against the ingress of fluid. A central stem extends upwardly from the main valve assembly and is actuable by a first operating means remotely from the upper housing to raise the main valve assembly off its seat, the wall of the lower portion of the housing above the seat having apertures. On raising the main valve assembly immersion fluid can enter the outlet, the net upward force thereby causing it to rise to the top of the upper chamber and permit full flow of the immersion fluid through the outlet. A second operating means is actuable remotely from the upper housing, to separately raise the main valve assembly off its seat and then exert a downward force on the main valve assembly, so that at a predetermined intermediate water level, the main valve assembly re-seats.

14 Claims, 4 Drawing Sheets

DUAL DISCHARGE VALVE

CROSS REFERENCE TO RELATED APPLICATION

This application is a National Phase application based on International Application No. PCT/GB01/02767, filed Jun. 22, 2001. This application, in its entirety, is incorporated herein by reference.

This invention relates to a discharge valve and is primarily intended for providing an easily operable fast flowing valve for emptying or partly emptying cisterns and other types of liquid containers. It is particularly, although not exclusively, applicable to being used to enable the amount of water used for flushing domestic toilets to be substantially reduced.

Flushing toilets and W.C.s in one form or another have been in existence throughout the modern world for a great many years. With the conventional low flush or close coupled toilet and pan, the means for achieving the flushing action consists of either a siphon (which until recently has been the only device allowed in the U.K.) or of one of a number of non-siphon type valves used extensively in other European countries and elsewhere in the world. Other types of non-siphon valves are used, but they are mainly for special applications without a cistern and rely on a high pressure water supply for discharging water through nozzles directly into the pan. However this "cisternless" non-siphon type valve does not fall within the scope of this invention.

Non-siphon, "drop" or "flapper" type valves have a valve plate or main valve member, which covers and seals the outlet to prevent water from escaping unintentionally. Both the siphon and the drop valve usually have a threaded outlet pipe which extends downwards through the bottom of the cistern into which it is fixed by a bulkhead fitting. Connection to the pan is either direct (close coupled) or by a short length pipe.

With the water discharged from the cistern being the sole means of cleaning or flushing the pan, the efficiency of the flush is mainly dependent on flow rate. The flow rate depends both on the efficiency of the flushing device and the channels and apertures around the top of the pan. Moreover with some flushing devices, a considerable amount of water is required to achieve a satisfactory flush and when incorporated in some installations, particularly with restricted galleries and uneven distribution around the rim of the pan, flushing performance and flow rate are so low, that in some cases, more than one flush is necessary.

Non-siphon valves generally achieve greater flow rates and substantially increased kinetic energy of the water entering the pan; thus enabling less water to be used for achieving an effective flush. In fact the performance of most existing U.K. WCs could be appreciably improved by fitting a drop type valve (particularly of the dual flush type, where approximately only half of the cistern contents are discharged at maximum flow rate). In any case the majority of flushes only require a partial flush. Other existing installations elsewhere could accommodate even higher flow rates than are generally available with most existing flushing devices. For new installations, by designing the galleries and contours of the pan to accommodate the higher flow rates and performance of discharge valves of this type, the quantity of water required for effective full flushing or partial flushing can be substantially reduced. In addition, these high efficiency valves enable simplification of the pan design e.g. open rim instead of box rim enables wider moulding tolerances and allows considerable cost savings on tooling and in the manufacturing process.

One of the main objectives of this invention is to enable the amount of water required for effectively flushing toilets to be further reduced (e.g. for the U.K., from 6 liters to 4.5 liters full flush).

Another objective of this invention is to provide an easily operable, high performance, low cost discharge valve with excellent reliability and high sealing integrity to enhance the performance of both new and existing WC's.

It is a further objective of this invention to provide a full or variable flush, a so called partial flush valve (typically on partial flush, only using 2 to 2.5 liters instead of 6 liters, a saving of 3.5 to 4 liters on every flush). With nine out of ten flushes only requiring a partial flush, on the basis of an existing 6 liter single flush, an overall saving of between 50 and 60% could be made on the water used for flushing.

It is also an objective of this invention to provide a convenient full capacity overflow means through the valve, a so-called integral overflow.

This invention is a development of my previous invention, Cistern Outlet Valve, UK Patent Application GB 2 336 605 A and International Patent Application No. PCT/GB99/01053 (publication number WO 99/54563), new and additional features have been incorporated to achieve a functionally and ergonomically acceptable dual flush action.

Accordingly, the present invention provides a device for immersion in fluid, in a cistern, which comprises a housing having an upper portion and a lower portion; an upwardly movable main valve assembly within the housing and forming therewith a variable volume upper chamber and lower chamber, a first vent means between the upper and lower chambers and an outlet leading down from the lower housing portion, which portion contains a seat for the main valve assembly at the entry to the outlet so that in the lowered position of the main valve assembly the outlet is blocked against the ingress of fluid in which the device is immersed; a central stem extending upwardly from the main valve assembly and actuable by a first operating means remotely from the upper housing to raise the main valve assembly off its seat, the wall of the lower portion of the housing above the seat having apertures, whereby on raising the main valve assembly immersion fluid can enter the outlet, the net upward force acting on the assembly thereby causing it to rise to the top of the upper chamber and permit full flow of the immersion fluid through the outlet and, on its substantially complete discharge the cessation of flow causing the main valve assembly to revert to its seated position, a second vent means being provided in the upper housing for ejection of fluid from the upper chamber by the rising main valve assembly whereby air can penetrate into the upper chamber via the first and second vent means during descent of the main valve assembly, the upper housing portion having a central hollow boss through which the central stem extends and an annular pocket being formed as a recess bound by a wall extending downwardly from the upper surface of the main valve assembly and joined at its lower end to the stem, the boss extending into this pocket, which acts as a water trap labyrinth, characterised by a second operating means, also actuable remotely from the upper housing, to separately raise the main valve assembly off its seat and then to exert or enable to be exerted a downward force on the main valve assembly so that at a predetermined intermediate water level in the cistern during discharge, the main valve assembly re-seats.

Thus the downward force exerted on the main valve assembly by the second operating means will be sufficient to exceed water level dependent flow reaction and pressure forces acting upwards on the surface underneath the main valve assembly, in order to achieve the desired re-seating for a partial flush. This surface is preferably frusto-conical tapering towards the outlet and is also preferably of concave configuration.

The downward force exerted by the second operating means may be applied by direct means, e.g. a latching device or catch mechanism engaging with a detent, e.g. a collar or similar feature, on the central stem to apply a downward force to the raised main valve assembly via a spring, weight or other force producing means—the force disengaging on re-seating of the valve.

A third vent means may be provided through the top of the upper housing, actuable only by the second or partial flush operating means, to allow air or immersion fluid to freely penetrate into the upper chamber.

On replenishment of the immersing fluid, it will be appreciated that an additional force acts on the main valve assembly, this being mostly due to hydrostatic pressure on top of the main valve assembly, thus providing increased seating force.

The central upwardly extending stem is preferably a hollow stem protruding above the normal full level of the fluid in the cistern and so (particularly with a funnel shape at the top) provides a convenient and efficient discharge route for fluid to the outlet, should the fluid level rise above the normal full level. An overflow route is thus provided through the outlet. The invention is more specifically described below with reference to a hollow stem, although it will be appreciated that this is not essential.

The first vent means may conveniently be a restricted passage or pressure balance aperture between the upper and lower chambers—generally for enabling fluid to enter the upper chamber during refilling and to restrict flow between the upper and lower chamber during operation.

For enabling the main ejection of fluid from the upper housing as the main valve assembly rises, a second vent means is provided. The vent means may be, for example, an annular ejection port or siphon duct and may additionally include a pressure balance aperture, non-return valve or vent hole to assist fluid flow back into the upper chamber on refilling of the cistern.

As indicated above, to enable an additional means for fluid to flow to and from the upper chamber during partial flush operation, a third vent means can be provided. This may consist of an actuable vent valve, opened only for partial flush operation and remaining open until the downwardly urged main valve assembly was re-seated.

Moreover the partial flush actuating device can be linked to the third vent means and can be made to engage with the hollow stem to enable it and the main valve assembly, with which it forms an integral part, to initially move upwardly to the open position and there remain until the downward force on the main valve assembly (which maybe exerted for example by a spring or hydrostatic means) is sufficient to cause the re-seating or closing of the valve at the set partial flush level.

On cessation of flow of the immersing fluid into the outlet following either emptying of the cistern or a partial operation, air or immersing fluid enters the upper chamber mainly via the second or third vent means, e.g. a siphon duct, vent valve or an annular channel between the upper housing boss and central stem and/or to a lesser extent the air/immersing fluid enters by the first vent means.

At the end of the full flush cycle, the main valve and hollow stem assembly descend to the seated position (the valve closed) under gravity. In the case of the discharge being stopped at an intermediate level by a partial flush operation, on the other hand, the valve assembly is returned to the seated position by downwardly acting spring force, hydrostatic force or other force means.

With the valve re-seated, either following a full or partial flush, as refilling takes place some immersing fluid penetrates the upper chamber via the pressure balance aperture, and immersing fluid then either totally or only partly fills the upper chamber. In any case whether the upper chamber contains air, immersing fluid or a combination of each, pressure due to the head of the immersing fluid presses down on top of the main valve assembly (piston) thereby increasing the seating force.

For W. C. outlet valves, the immersing fluid is of course water and the invention will hereafter be described with reference to water for convenience.

For a better understanding of the invention, the main embodiments will be described, by way of example only, with reference to the accompanying drawings, wherein.

Figure 1:
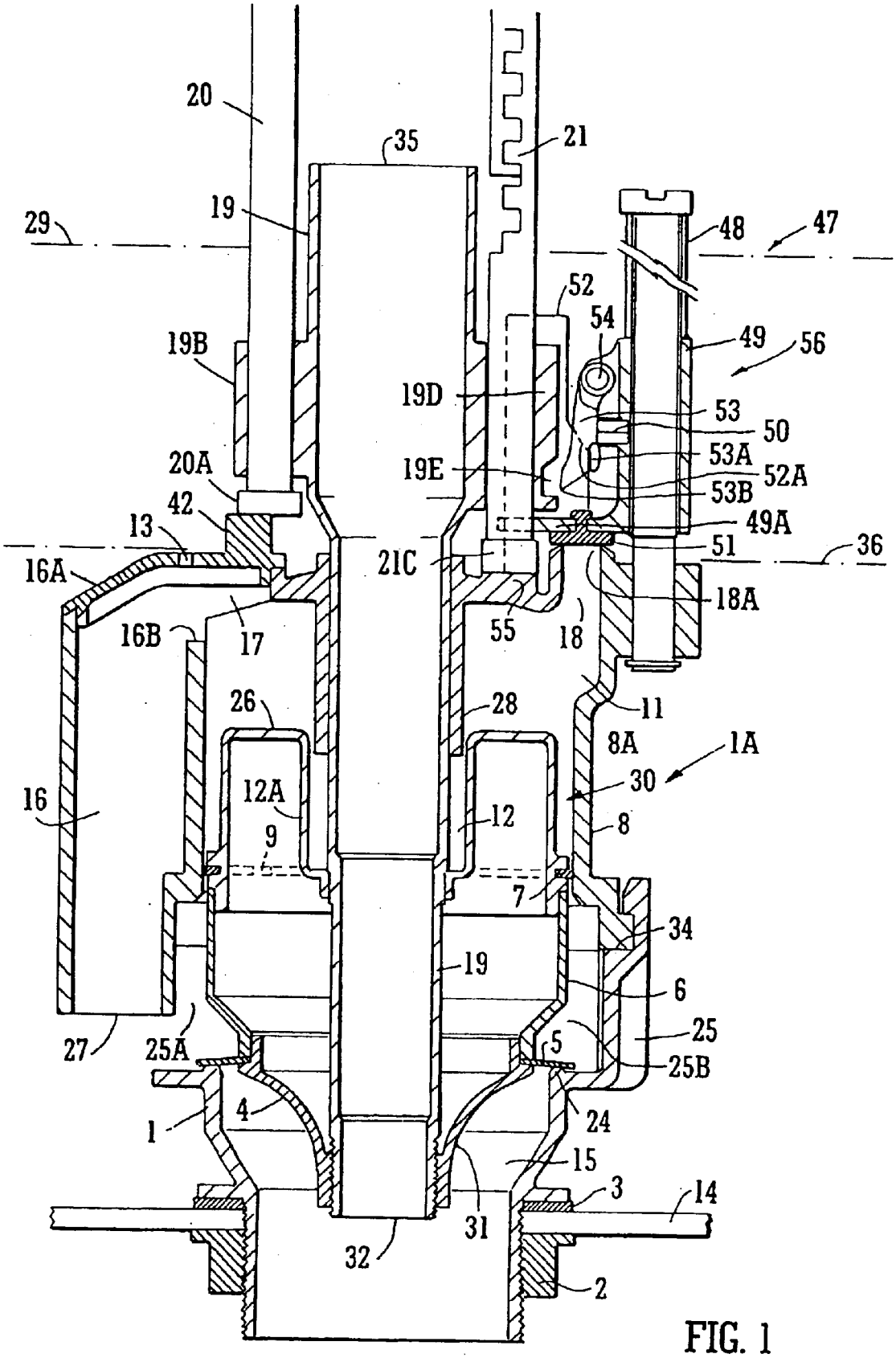
FIG. 1 shows a part sectional arrangement of a device according to one embodiment of the invention, being a first dual flush discharge valve with separate actuating means for partial and full flush, with a latching device on the partial flush actuating means, the valve being in the closed position.

FIG. 1 shows a cistern discharge/dual flush valve generally as indicated at 1A, sealed and retained by a seal 3 and nut 2 into an outlet at the bottom of a cistern 14. The valve 1A is immersed in water to a set level 29 and the valve is closed with a main seal 5 sealing onto outlet base 1 against seat 24 in a lower portion of the valve housing to prevent the ingress of water from the cistern. The valve housing has an upper chamber 11, which is filled with water and is in free communication with the water in the cistern via port 17 and siphon ejection duct 16 and to a lesser extent by a pressure balance aperture 9 (conveniently provided by an enlarged sealing ring gap). In the closed position the main valve assembly 30, which comprises a piston body 6 and a hollow stem 19, is kept in place by the weight of the assembly and the pressure of water on piston top 26.

Communication between the cistern water and water in the lower annular region 25B inside the lower valve housing is provided by the apertures 25A between the supporting pillars 25 above the seat 24. As seal 5 is lifted off seat 24, water from the cistern can then flow through to the outlet 1, 15.

The upper chamber 11 is defined between the extension wall 8A of the upper part of the valve housing 8, a hollow central boss 28 and the upper surface 26 of the movable valve or piston assembly 30. The main valve assembly 30 moves up and down inside the upper chamber and is sealed by means of a sealing ring 7, which remains in contact with the interior of wall 8A.

The hollow body 6 of the main valve or piston assembly 30 defines from its upper central region a downwardly extending annular wall 12A which is joined at its lower end to a hollow central stem 19. The stem 19 extends fully through the housing from its lower outlet end 32 to above the water level 29 in the cistern. The hollow stem is supported at the top and aligned with the upper housing 8. Between wall 12A and stem 19 is defined an annular pocket 12, the function of which is described later.

With the cistern filled to the set level 29, operation of the valve is achieved initially by lifting the main valve assembly 30, including its hollow stem, off its seat 5, 24. This is carried out by either of two shoulders 20A, 21C, of pull up rods 20, 21 engaging with their respective stem bosses 19B or 19D and raising the said assembly above the valve seat sufficient to allow water to enter and fill the entrance to the outlet 15. Preferably for ergonomic reasons these rods may be operated remotely by push buttons on the cistern cover connected through a suitable stroke increasing mechanism.

For full flush operation, with the main valve assembly raised sufficiently off its seat, the initial upward forces due to pressure and change in flow momentum over the concave curved surface 4, (underneath the main valve assembly) are sufficient to overcome the downward forces on the said assembly to enable it to start to rise, whilst at the same time ejecting and displacing water from the upper chamber via the channel/duct 16. Whereas at this stage the main valve assembly requires no further lifting action, the lift rod 20, 20A, is applied to fully raise the said assembly—this also enables the valve to open more quickly.

With the duct containing water, pressure on top of the upper piston 26 is at the same pressure as the pressure at the depth of water below the surface 29 (whilst the water level is above the top of the piston) and therefore does not increase to the pressure at a depth level with the bottom edge 27 of the duct (as would be the case if the upper chamber contained air).

With the main valve assembly 30, (piston and hollow stem assembly 6,19,) raised sufficiently above the valve seat to overcome the forces acting down on it and the assisted pull-up action from the lift rod 20, 20A, the said assembly 30 rises to the top of the upper housing 8 displacing the remainder of the water from the upper chamber 11 and discharging it from the bottom edge 27 of duct 16 into the cistern. With the valve fully opened, water is discharged through the outlet 1, 15 and into the toilet pan. The main valve assembly remains in the filly opened position during the early part of the discharge mainly due to the water pressure and reaction force produced by the change in momentum of the water flowing over the contour on the bottom surface 4, being greater than the force due to pressure on top of the said assembly and any downward forces due to negative buoyancy.

During the early stages of discharge, the main valve assembly remains at the top of the upper housing 9 and the water level in the surrounding cistern falls rapidly from its filling level 29. At the point when the level has fallen level with vent hole 13 near the top of duct 16, air can begin to enter the duct 16, slowly displacing water from it. This initially does not affect the assembly (piston) 30, since any downward force on the main valve assembly is resisted by vacuum applied by slight displacement of the labyrinth trap 12, 28 keeping the main valve assembly at the top of the housing 8. Moreover, even when the level has fallen below the lower flange 34, the ingress of air does not significantly increase, although there is an additional path for the ingress of air via pressure balance aperture 9. However, if the ingress of air in some embodiments were to cause early downward progression of the main valve assembly, in such cases this could be readily overcome by replacing the vent hole 13 by a non return valve which would allow no air into the duct 16. No air can enter through the clearance gap between the hollow stem 19 and the bore of the upper housing boss 28 as the annular pocket 12 in the piston contains water and in the raised position forms a simple labyrinth which acts as a very effective water/vacuum trap. Accordingly only when the water level has fallen below the bottom edge 27 of ejection duct 16 is there a rapid inrush of air into the upper chamber to release the main valve assembly, allowing it to descend and return to the re-seated position.

With the valve having just re-seated following a full flush, the upper chamber 11 and ejection duct 16 initially contain air, and refilling commences. As the water level rises and becomes level with the bottom edge 27 of the ejection duct, water in the cistern rises at a slightly greater rate than inside the ejection duct, due to the air inside being slightly compressed by restriction to the flow of air through the vent hole 13 (or non return valve if fitted). As refilling continues the level reaches the bottom flange 34 and water enters the space between upper housing wall 8A and the piston body 6 with air above the water being displaced through the pressure balance aperture 9 piston sealing ring gap) into upper chamber 11 and vented through vent hole 13.

Refilling continues and the water level rises in the gap between the piston and the bore of the upper housing and penetrates the upper chamber 11 via the pressure balance aperture. Water continues to flow into the upper chamber until it is full—the air being displaced and vented through vent hole 13. Filling continues and the water level in the cistern rises above the upper housing and up until the filling level 29 is reached—this being the point at which a conventional control float (not shown) shuts off the water inlet to the cistern.

The means of applying the required downward force to the main valve assembly at the partial flush level is achieved by a spring latching mechanism 47. With this mechanism, the partial flush proportion can be conveniently varied by an adjustment screw or similar means at the top of the valve.

For selection of the partial flush facility, second operating means is employed. The second operating means comprise means for raising the main valve assembly, which includes the lift rod 21, when actuated which causes foot 21C to engage with the flange 49A of sliding carrier 49, which then engages with boss 19D of hollow stem 19. This results in the main valve assembly 30, being raised sufficiently for the forces due to the reaction from the change in momentum over the contour 4 and water pressure underneath the main valve assembly to assist in raising the said assembly to the top of the upper housing. Again opening of the valve is further assisted by the lift rod being applied to raise the said assembly to the top of the upper chamber 11. At the same time as the foot 21C engages with the flange 49A, the seal pad 51 is raised from its valve seat 18A to open the vent valve 18. Up to this point the vent valve is kept closed due to the downward compression force of water level control spring 48 acting on it.

Raising the lift rod 21, 21C, to the top of its stroke also raises the sliding carrier 49 to the top of its stroke and compresses spring 48. With both the main valve assembly and the sliding carrier in the fully raised position, the pawl 53, under the action of low force compression spring 50, engages with the hollow stem boss 19D such that the pawl tooth 53B enters and engages with the groove 9E of the hollow stem boss. At this point, with the valve fully open, the lift rod 21 is released and can fall back to its lowest position, resting on stop 55.

During the opening of the valve, i.e. the raising of the lift rod 21, 21C, and main valve assembly 30, water displaced from the upper chamber 11, flows via port 17 into the ejection port 16 and through vent port 18 into the surrounding cistern.

The second operating means also include means for exerting a downward force. Thus with the valve open, water flows through apertures 25A and into the outlet 1, 15—the water level in the cistern then rapidly starts to fall. At this point, as already described, the pawl 53 is engaged or latched with the stem boss 19D and exerting a downward force on the main valve assembly. Also at the start with the water level in the cistern at the set level 29, the upward forces acting on the main valve assembly due to hydrostatic pressure and flow reaction on the curved surface 4, underneath the said assembly, are substantially greater than the net downward force exerted by control spring 48.

As the water level in the cistern falls, the net upward forces on the main valve assembly due to flow and pressure diminish. The level continues to fall until it approaches the pre-determined intermediate level, at which point the downward force from the spring 48 balances and quickly exceeds the upward forces on the main valve assembly, whereupon water can be readily drawn into the upper chamber 11, via the duct 16 and air/water through the open vent valve 18, causing the said assembly to rapidly descend and re-seat.

The re-seating/downward force from spring 48 is transmitted to the sliding carrier 49, via pivot 54 and through the pawl 53 to stem boss 19D, such that for the majority of the downward stroke, the main valve and sliding carrier assembly move down together. As the main valve assembly approaches the re-seated or closed position, lugs 53A come into contact with cam profiles 52A of guide plates 52, causing the pawl 53 to disengage from the stem boss/groove 19D, 19E. The main valve assembly and carrier assembly 56, then continues to move independently for the remainder of the descent. This then culminates in the main valve assembly re-seating on seat rim 24 and the seal pad 51 re-seating on seat rim 18A to close vent port 18. Thus by exerting a downward force on the main valve assembly, the valve is made to close at a predetermined intermediate level 36, and thereby achieve a partial flush.

Dependent on where the level 36 is in relation to the top of the vent valve (seat rim 18A) the upper chamber 11 will contain either air or water or a combination of each.

With the valve re-seated refilling commences, and this is of course virtually the same as for re-filling following a full flush operation, except that the upper chamber 11 may contain water, in which case little or no air would need to be displaced or vented from the upper chamber via vent hole 13. Also re-filling starts at an intermediate water level 36 (the partial flush level). Moreover it will be appreciated that following a partial flush, refilling is much quicker and the amount of water required to replenish the cistern to the set level 29 is considerably reduced (typically 50% of the full flush cistern volume). As before when the set level is reached a conventional control float shuts off the water inlet to the cistern.

In the event of the inlet valve not shutting off when the cistern has filled to the set water level, the water level will continue to rise until it reaches the top edge 35 of the hollow stem 19 and from then on downwards through the hollow stem and into the toilet pan. The hollow stem (overflow) is capable of handling the full flow of a failed water inlet valve and meeting the most stringent of standards.

Figure 2:
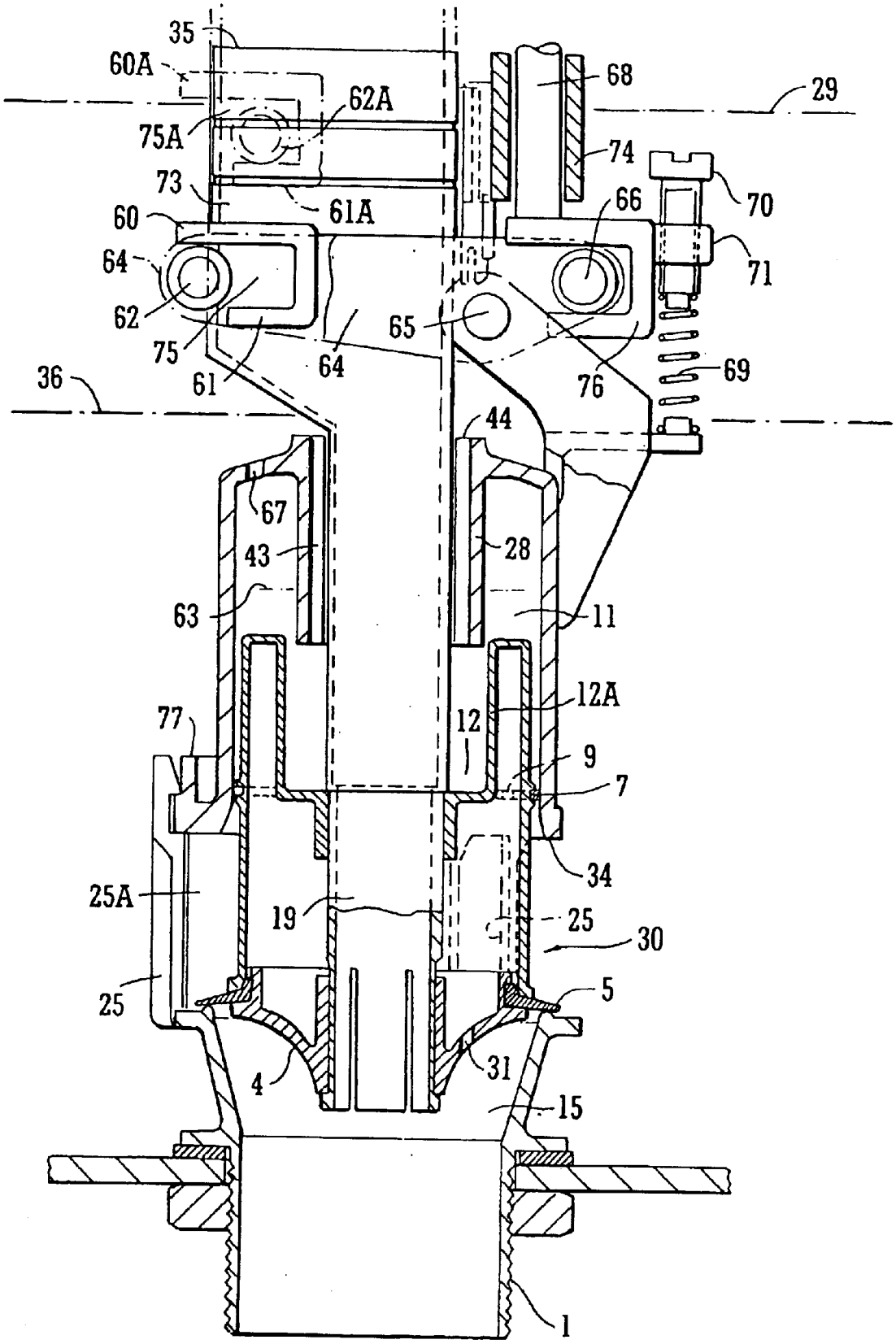
FIG. 2 shows a sectional arrangement of a second dual discharge valve with a second type of latching device on the partial flush operating means and typical actuating mechanism, again the valve being in the closed position.

FIG. 2 shows an arrangement similar to FIG. 1, with an alternative second operating means/actuating mechanism and central annular discharge channel, the valve is in the closed/seated position with the cistern filled to the set water level 29. Although it is not intended to vary the buoyancy of the main valve assembly, by allowing water to enter the piston body, incorporating this feature could quicken up re-seating at the end of a full flush operation.

The lever/latching mechanism shown is for partial flush operation and is disposed to one side of a narrow oblong upper funnel 73. On the other side (not shown) there is a similar lever arrangement for operating the full flush discharge. As before, the main difference between full and partial discharge operation is that for partial operation there has to be a means of engaging and exerting a downward force to close and re-seat the main valve assembly at an intermediate water level in the cistern. This basically involves three items, the capturing slot 75 (integral with the upper stem funnel 73), level control spring 69 and screw 70 or other adjustment means. For fill flush operation, the opposite lever to lever 64, does not have lower jaw 61, nor is there a spring 69, screw 70 or threaded boss 71.

For the arrangement shown, operation of the partial flush involves pressing a push button on the cistern cover or on the outside of the cistern, which for the configuration shown, in turn causes the rod 68, to move downwards, compressing control spring 69 and impart its motion via slotted jaw 76 to roller/pin 66 on lever 64. This causes lever 64 to tilt about pivot 65 and for the roller/pin 62, at the other end of lever 64, to move upwards and push against upper jaw 60 to raise the main valve assembly 30, off its seat. As the main valve assembly rises, the roller/pin 62 moves into the slot 75 until with the valve fully open, the slot 75 (which is integral with the upper stem 73) has been raised to the position 75A. At this position (62A, 61A) the roller/pin 62 is above the lower jaw 61.

During the raising of the main valve assembly to the top of the upper housing, water is mainly displaced from the upper chamber 11, via the variable labyrinth 12 defined by 12A, 28, 19 and annular segmented channels 43, into the cistern.

With the valve fully open, water flows via the apertures 25A, into the outlet 15, 1 and into the pan. The water level in the cistern continues to fall from the set level 29 and as it approaches the predetermined intermediate level 36, the force of the spring 69, applied to the main valve assembly via the bottom jaw of the slotted end 76, roller/pin 66, lever 64, roller/pin 62 and bottom jaw 61A on the upper stem exceed the upwardly acting flow reaction and hydrostatic forces on the curved surface 4.

This causes the main valve assembly to rapidly descend and in doing so, drawing water into the upper chamber 1, via the annular segmented channels 43. If the intermediate water level were to be set below the top edge 44 of the annular channels, air would be drawn into the upper chamber. If this were to become the normal setting for the valve in a particular type of cistern, the bottom of boss 28 could be taken up to the position designated 63. This would be in order to reduce the effect of labyrinth vacuum applied when the water level falls below the top edge 44, of the annular channels. To a lesser extent on the descent of the main valve assembly, air or water also enters the upper chamber via vent hole 67 and water enters via pressure balance aperture 9.

With the valve re-seated, refilling (from the intermediate level) commences and proceeds in the manner as already described for the previous embodiment. Water enters the upper chamber via pressure balance aperture 9, to displace any air through vent hole 67.

Full flush operation is achieved by downward movement of a rod, similar to rod 68, with again the initiating action being a push button on the outside of the cistern. The push rod 68 tilts a lever similar to lever 64 and raises the main valve assembly in the same way to the top of the upper housing 8. Water from the upper chamber is ejected from the upper chamber in the same way as for the partial flush—mainly via the labyrinth and annular segmented channels.

As the water level continues to fall and approaches the vicinity between the predetermined intermediate level 36, and back flange 77, the flow reaction and hydrostatic forces acting on the curved surface 4, are no longer sufficient to support the weight and negative buoyancy of the main valve assembly. From then on, these water depth dependent forces diminish still further. To maintain the main valve assembly at the top or near to the top of the upper housing until the cistern is empty, the progressively increasing downward force on the said assembly is counteracted by vacuum pressure from the labyrinth. There is of course gradual downward movement of the main valve assembly due to the slow ingress of air through the vent hole 67. Also when the water level has fallen below the upper housing bottom flange 34, air enters via pressure balance aperture 9 to increase the rate of descent of the said assembly but at a rate such that the main valve assembly re-seats shortly after the cistern is empty.

Figure 3:
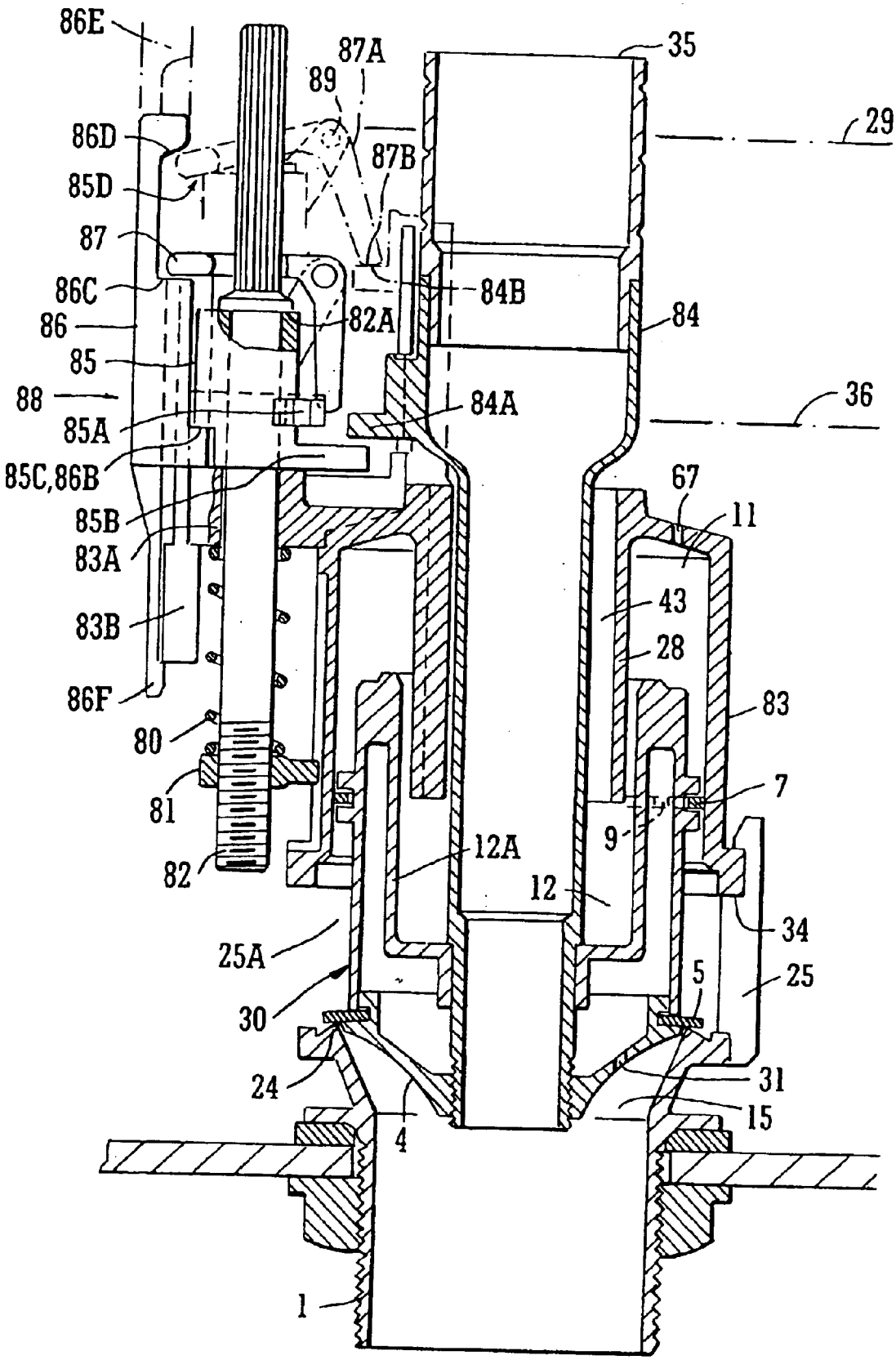
FIG. 3 shows variation of FIG. 1 of a dual flush discharge valve with a composite latching device for enabling full flush actuation to override the partial flush actuating means, the valve again being in the closed position.

FIG. 3 shows an arrangement with an actuating mechanism similar to FIG. 1 but to enable full flush operation to override the partial flush action should both of them be selected together (e.g. both partial and full flush button pressed at the same time)—unlike the embodiment shown in FIG. 1 which would default to partial flush operation.

With the basic valve assembly, as defined by main valve assembly 30, hollow stem 84, upper housing 83 and lower housing 1, with a central annular segment and channel 43, the arrangement shown in FIG. 3 is very similar to FIG. 2 and as such, functionally the operation of the main valve is as that described for FIG. 2.

The main difference between FIG. 3 and the other two embodiments is the actuating mechanism which integrates the partial and full flush into a single mechanism 88. Actuation is by separate adjustable length pull-up rods, (not shown) to which can be conveniently attached to a push button unit on the cistern cover. The pull-up rods are attached to the mechanism, on opposite sides, by clips, only one of which, 85A, is visible, which operate the partial and full flush sliding blocks 85 and 86, respectively.

With the valve in the closed position the partial flush sliding block 85 is held in the retracted position against bulk head 83A by compression spring/control spring 80, the force being applied by a shoulder 82A near the top of adjustment screw 82. The full flush sliding block 86 is constrained to the retracted position by the overlap edge 85C of partial flush sliding block 85. Also in the retracted or unoperative state, there is clearance between stem lug 84A and partial flush block flange 85B, which lies below it.

For partial flush operation, the partial flush block assembly, comprising sliding block 85, pawl 87, pivot 89, adjustment screw 82 and nut 81 is raised by the partial flush pull-up rod applying upward movement through clip 85A. The flange 85B engages with stem lug 84A to lift the main valve assembly off its seat 5, 24 and raise it to the fully open position the top of the upper housing 83.

In raising the main valve assembly to the open position, the pawl 87 comes into contact with contour 86D, which causes it to swivel about pivot 89 and take up the position 87A. On release of the operating action, the force from the fully compressed control spring 80, is transmitted via the pawl tooth 87B to the top of stem lug 84B and is further constrained by the stop 85D (top edge of partial flush sliding block).

As with the previous embodiments, the partial flush mechanism remains in the raised position until the water level has fallen to the partial flush level 36, whereupon the upward forces on the main valve assembly are no longer sufficient to keep the valve open against the downward force applied by the partial flush block assembly. At this point the force from the control spring causes the partial flush block assembly to descend, carrying the main valve assembly with it and causing it to re-seat. On approaching the fully descended/retracted position, the tilted pawl 87A contacts the stop 86C causing it to disengage from the stem lug top 84B, and return to the retracted configuration 87.

For full flush operation upward movement is applied to the full flush sliding block clip (not shown—this being on the opposite side to the clip 85A). The full flush sliding block 86 is mounted on guide post 83B and restrained from freely being raised (during partial flush operation) by friction lug 86F.

On raising the full flush sliding block, with it being underneath the partial flush sliding block and overlapping at edges 85C, 86B, both sliding blocks are raised together. The flange 85B lifts the stem lug 84A in the usual way to raise the main valve assembly 30, to the open position and water from the cistern flows into the outlet.

With both sliding blocks being raised together the pawl 87 is kept in the retracted position by step 86C and therefore with the complete mechanism 88, in the fully raised position, there is no engagement of the pawl with stem lug top 84B. On release of the pull-up rod, both sliding block assemblies are returned to the retracted position on top of bulkhead 83A by the control spring 80. The main valve assembly remains in raised position until the cistern is empty and then re-seats in the usual way. Refilling commences and the cistern fills to the set level 29 in the manner described in the other embodiments.

From the foregoing description, with the partial flush block being raised by the full flush block, it will be appreciated that operating both actions together will still result in full flush operation.

Other embodiments and combinations of the invention can of course be configured.

For instance a variation on FIG. 1 would be to eliminate the vent valve 18—particularly for a configuration where all the intermediate levels were above the duct cap 16A, so that water would almost totally be drawn into the upper chamber via the duct 16 instead of through the vent port 18.

A further means of adjustment of the pre-determined intermediate level would be to vary the contour or position of the curved surface 4, underneath the main valve assembly.

A further improvement to FIG. 1 would be to reduce any tendency of back flow from the ejection duct 16, into the upper chamber 11, as the water level in the cistern is falling and approaching the predetermined intermediate level 36, during a full flush operation. This could be achieved by increasing the heights of the sill 16B, ejection port 17, cover 16A and vent hole 13 so that they would be above the highest setting of the intermediate water level for the deepest portrait cistern.

Figure 4:
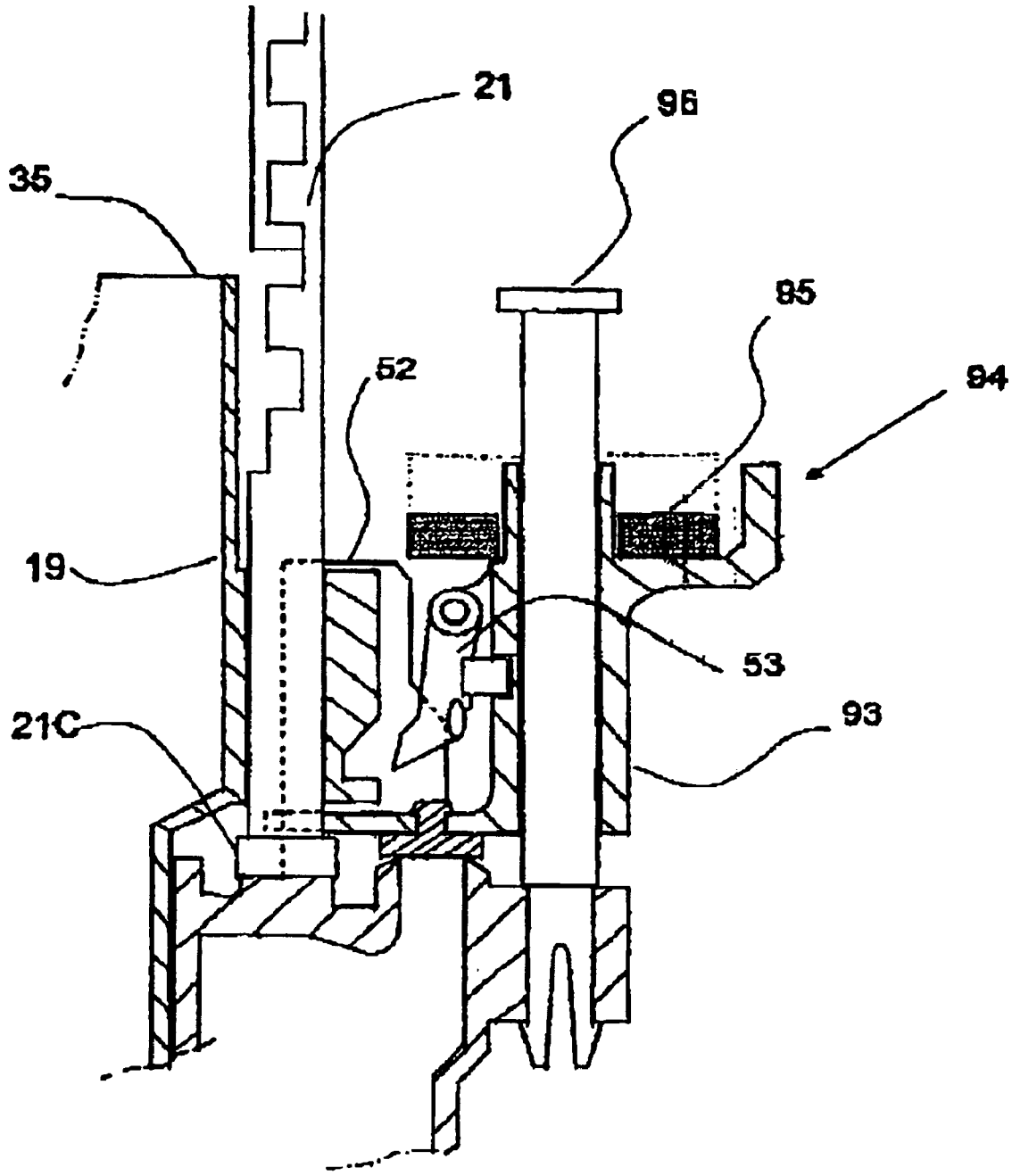
FIG. 4 shows variation of FIG. 1 of a dual flush discharge valve in which the downward force is applied via a weight.

FIG. 4 shows an arrangement in which the downward force is exerted by a weight 95. The weight 95 is supported on the sliding carrier 93 of the carrier assembly 94. The sliding carrier is supported by member 96.

What is claimed is:

1. A device for immersion in fluid, in a cistern, which comprises:

a housing having an upper portion and a lower portion;

an upwardly movable main valve assembly within the housing and forming therewith a variable volume upper chamber and a lower chamber;

an outlet provided in the lower housing portion;

a seat for the main valve assembly provided in the lower housing portion at the entry to the outlet so that in the lowered position of the main valve assembly the outlet is blocked to prevent fluid in which the device is immersed from flowing through the outlet:

a central stem extending upwardly from the main valve assembly and actuable by a first operating means remotely from the upper housing to raise the main valve assembly off its seat, the main value assembly being formed underneath with a surface arranged so that on raising of the main valve assembly it is subjected to upwards force by fluid flowing from the lower chamber into the outlet thereby causing the assembly to rise to the top of the upper chamber and permit full flow of the immersion fluid through the outlet whereupon the cessation of flow as a result of substantially complete discharge of all the immersion fluid causes the main valve assembly to revert to its seated position; and a second operating means, which is also actuable remotely from the upper housing, which is operable to raise, separately and independently of the first operating means, the main valve assembly off its seat and then to exert or enable to be exerted a downward force on the main valve assembly when the main valve assembly is in a raised position, sufficient to exceed the upwards, water level dependent, flow reaction force acting upwards on the underneath surface of the main valve assembly so that the main valve assembly re-seats at a predetermined level before complete discharge of all the immersion fluid so that there is a partial discharge of the fluid, the second operating means comprising means for raising the main valve assembly and means for engaging and exerting a downward force to act on and engage with the central stem to cause partial discharge of the immersion fluid.

2. A device according to claim 1, in which the downward force exerted by the second operating means is caused by a latching device or catch mechanism engaging with a groove on the central stem to apply a downward force to the raised main valve assembly, which force is disengaged on re-seating of the valve.

3. A device according to claim 2, in which the downward force is applied via a spring or a weight.

4. A device according to claim 1, in which the downward force exerted by the second operating means is caused by a pivoted lever, one end of which is forced downwardly to compress a spring on actuation of the second operating means, the other end bring thereby moved upwardly to cause raising of the main valve assembly.

5. A device according to claim 1, in which an adjustment screw at the top of the valve provides a means of varying the amount of the partial flush actuated by the second operating mean.

6. A device according to claim 1, in which a third vent means is provided through the top of the upper housing, the third vent means being actuable only by the second operating means to allow air or immersion fluid to penetrate into the upper chamber.

7. A device according to claim 6, in which the second operating means is lid to the third vent means and engages the central stem whereby it moves upwardly with the main valve assembly to the open position.

8. A device according to claim 1, in which the central stem is a hollow stem prodding above the normal full level of immersing fluid in the cistern.

9. A device according to claim 1, in which the first vent means is a restricted passage or pressure balance aperture between the upper and lower chambers.

10. A device according to claim 1, in which the second vent means comprises an annular ejection port or siphon duct.

11. A device according to claim 10, in which the second vent also includes a pressure balance aperture, non-return valve or vent hole.

12. A device according to claim 1, which includes a composite latching device to enable the first operating means to override the second operating means.

13. A device according to claim 1, in which the underneath surface of the main valve assembly is frusto-conical tapering towards the outlet.

14. A device according to claim 13, in which the underneath surface is concave.

* * * * *